US006189737B1

(12) United States Patent
Condon

(10) Patent No.: US 6,189,737 B1
(45) Date of Patent: Feb. 20, 2001

(54) SQUEEZABLE TUBE CLIP AND RETAINER

(76) Inventor: Harry F. Condon, 1827 Almeda, Hillsdale, MI (US) 49242

( * ) Notice: Under 35 U.S.C. 154(b), the term of this patent shall be extended for 0 days.

(21) Appl. No.: 09/409,190

(22) Filed: Sep. 30, 1999

(51) Int. Cl.[7] ..... B65D 35/28
(52) U.S. Cl. ..... 222/103
(58) Field of Search ..... 222/103, 95; 383/89, 383/90; 251/4, 9; D9/442

(56) References Cited

U.S. PATENT DOCUMENTS

| | | | | |
|---|---|---|---|---|
| 4,159,787 | | 7/1979 | Wright . | |
| 4,574,983 | * | 3/1986 | Fatkin | 222/95 X |
| 4,928,851 | | 5/1990 | Eatherly . | |
| 4,976,380 | * | 12/1990 | Von Schuckmann | 222/103 |
| 5,071,036 | | 12/1991 | Kelly et al. . | |
| 5,222,629 | | 6/1993 | Tal . | |
| 5,442,839 | | 8/1995 | Miller . | |
| 5,549,221 | | 8/1996 | Conlee . | |
| 5,782,385 | | 7/1998 | Soon . | |
| 5,920,967 | * | 7/1999 | Souza | 222/103 X |

* cited by examiner

*Primary Examiner*—Kevin Shaver
*Assistant Examiner*—Eric Keasel
(74) *Attorney, Agent, or Firm*—Young & Basile, P.C.

(57) ABSTRACT

A tube clip for use with flexible wall dispensing tubes to aid in the dispensing of the tube contents includes a body having a slot in which the closed end of the tube is received so that movement of the body along the tube squeezes the tube to displace the tube contents toward the tube cap. The clip body includes a retainer for retaining that portion of the tube which has been squeezed and emptied, and the retainer permits the emptied tube end to be folded and tucked under the retainer to maintain the tube of a concise configuration and shape as it is used.

6 Claims, 2 Drawing Sheets

SQUEEZABLE TUBE CLIP AND RETAINER

BACKGROUND OF THE INVENTION

1. Field of the Invention

The invention pertains to clips for aiding the dispensing of contents from a flexible wall tube wherein the clip includes tube retaining means for those portions of the tube emptied of the tube contents.

2. Description of the Related Art

Collapsible wall tubes have long been used to package paste goods and the like such as toothpaste, glue, beauty and hair preparation products, and the like. Initially, such collapsible wall tubes were formed of thin metal, and as the tube contents were utilized, the tube closed end was folded or rolled wherein the tube contents were forced into that portion of the tube adjacent the tube cap, and the length of the tube lessened as the contents were dispensed. The metallic construction of the tube permitted the tube closed end to maintain its deformed configuration as the closed tube end is folded or rolled as the tube contents are depleted.

In more recent years, many products are now packaged in flexible wall tubes formed of a synthetic plastic material. Such plastic tubes sometimes utilize metallic metal foil liners, but because of the resilient nature of the plastic tube material, the tube end cannot be rolled or folded as the product is dispensed and the tube end will not maintain the rolled or folded configuration once released by the user. Such plastic tubes tend to assume the original "full" appearance regardless of the amount of material within the tube. This self-shaping of the tube tends to draw air into partially emptied tubes which becomes troublesome during dispensing, and the user cannot visually determine the amount of product within the tube. Further, such plastic tubes are difficult to squeeze and completely empty, resulting in waste of an expensive product.

To improve the use of synthetic plastic flexible wall tubes, various devices have been proposed to aid in the squeezing of the contents from the plastic tube, such as shown in U.S. Pat. Nos. 4,159,787; 4,928,851; 5,071,036; 5,222,629 and 5,782,385. Also, devices have been proposed for gripping the empty end of the tube as shown in U.S. Pat. Nos. 5,442,839 and 5,549,221.

While the above mentioned patents aid in discharging the contents from a synthetic plastic tube by permitting the tube to be uniformly squeezed throughout its width, known devices have not been capable of both aiding in the dispensing of goods from a flexible wall plastic tube and also retaining the closed tube end from which goods have been removed. The use of a plastic tube clip which will retain the emptied closed tube end is highly desirable as such a device would make the tube more concise as it is being used, and will prevent the product from flowing into the tube end from which it has been dispensed.

OBJECTS OF THE INVENTION.

It is an object of the invention to provide a tube clip for use with plastic flexible wall tubes which aids in dispensing the tube contents to effectively empty the tube, and which also retains the empty closed tube end in a concise manner.

A further object of the invention is to provide a tube clip for synthetic plastic tube ends wherein the clip is of a concise configuration, may be easily utilized by people of ordinary skill, and is effective to keep the tube configuration concise, and yet visually indicate the amount of product within the tube.

SUMMARY OF THE INVENTION.

A tube clip in accord with the invention is preferably molder of a synthetic plastic material and includes a body having front and rear sides. A slit intersects the front and rear sides whereby the closed end of a synthetic plastic tube may be received within the body slit and pulled therethrough wherein movement of the clip along the tube length will squeeze the contents of the tube, forcing the contents toward the tube cap end and opening. Of course, the slot needs to be of a length at least as great as the lateral dimension of the tube when squeezed, and the opposing edges of the slot are close enough together to firmly receive the tube closed end and effectively squeeze the tube sides toward each other as the clip is moved along the tube during dispensing.

The rear side of the clip body is provided with retainer projections which extend away from the direction of clip body movement during tube dispensing. These projections define shoulders relatively close to the body rear side wherein as the tube is emptied, the closed empty tube end may be folded and tucked under the projections. The retainer projections will maintain the folded tube end in the folded condition, and permit the total length of the tube to be progressively decreased as the tube contents are depleted.

The tube end retainers are easily utilized by those of ordinary skills, and as the tube contents are depleted, the tube end will usually have to be folded and refolded to accommodate the changing tube length.

The clip of the invention may be used to dispense very high viscous materials such as an adhesive. In such instance, squeezing of the tube may tend to move the clip rearwardly away from the cap. When used with highly viscous materials, the tube end retainers may include holes defined in opposing sets of retainers whereby pins may be inserted through the retainer holes and the tube locking the clip body to the tube and preventing relative movement between the tube and clip body during dispensing.

BRIEF DESCRIPTION OF THE DRAWINGS.

The aforementioned objects and advantages of the invention will be appreciated from the following description and accompanying drawings wherein.

DESCRIPTION OF THE PREFERRED EMBODIMENTS.

Figure 1:
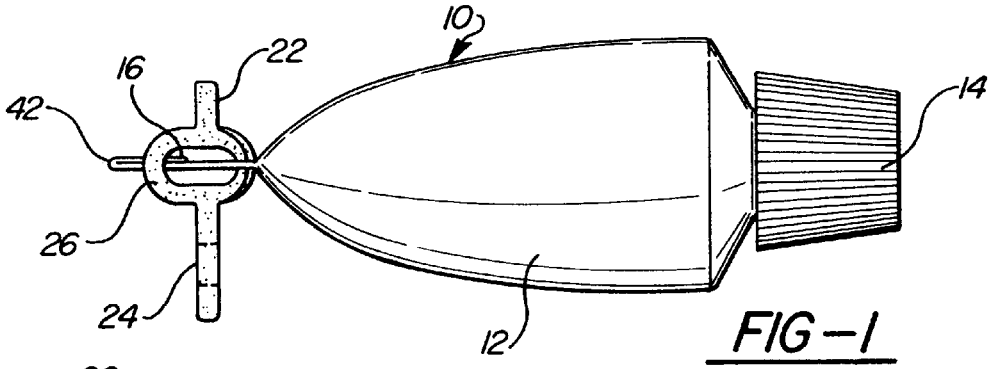
FIG. 1 is an elevational end view of a synthetic plastic tube having a tube clip in accord with the invention mounted thereon.
Figure 2:
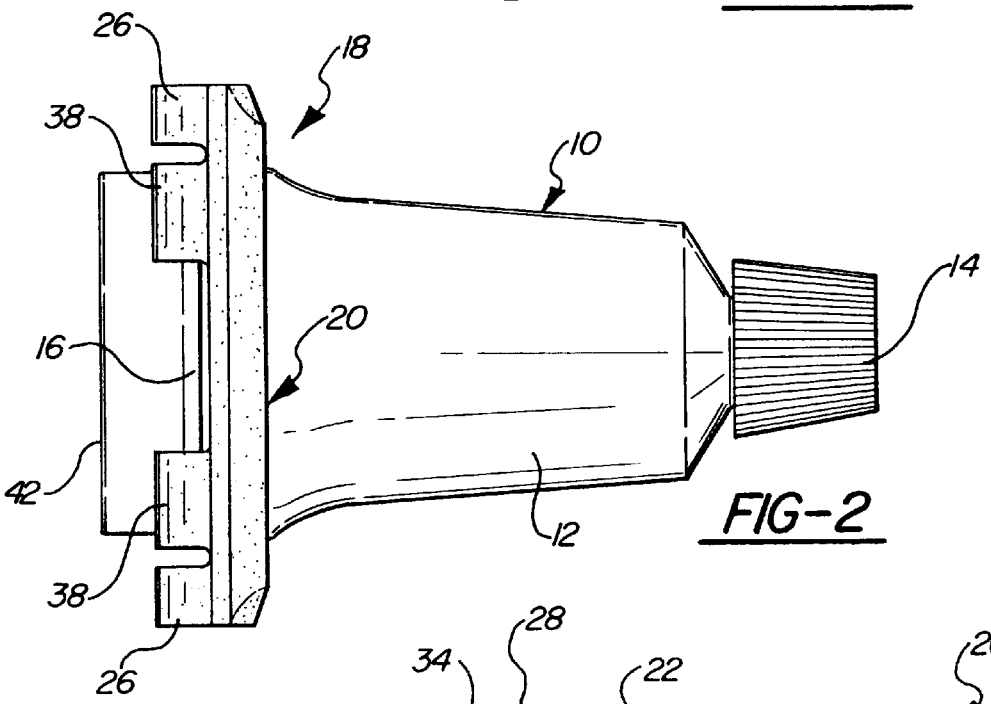
FIG. 2 is a top plan view of FIG. 1.

The environment in which the invention is used, and the relationship of the tube clip to a synthetic flexible wall tube will be appreciated from FIGS. 1 and 2. In these figures, the synthetic plastic tube is generally indicated at 10, the tube including a flexible tube wall 12 and a removable cap 14 at its right end. Of course, removal of the cap 14 provides access to the interior of the tube whereby the contents thereof may be discharged through this capped opening. The tube wall 12 is closed at the end remote from the cap 14 as indicated at 16 in FIGS. 1 and 2.

The tube clip is generally indicated at 18 and includes a body 20 which is preferably injection molded of a strong rigid synthetic resin or the like. The body 20 includes a front side 22 and a rear side 24, and the body also includes end regions 26 which are of a generally C-shaped configuration as will be apparent from FIG. 6 and function as a spring to keep the slots in engagement with the tube. The upper portion of the body 20 can be identified as the upper bridge 28, while the lower portion constitutes a lower bridge 30 which also serves as a handle, the bridge portions homogeneously associate with the C-shaped end regions 26 whereby end regions 26 maintain the relationship of upper bridge 28 and lower bridge 30.

Figure 3:
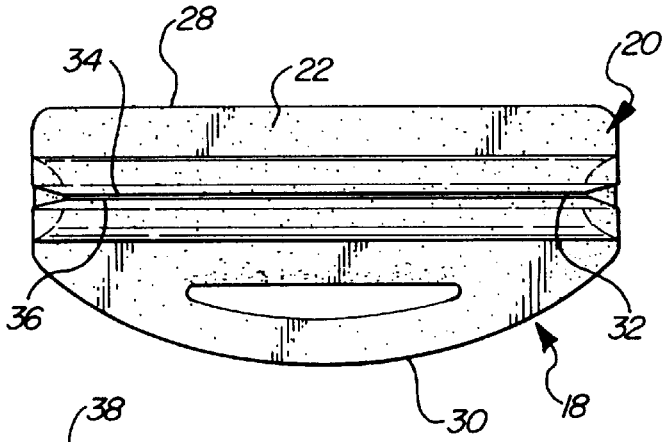
FIG. 3 is an elevational view of the front side of a tube clip in accord with the invention.

The bridge portions 28 and 30, at the front side 22, are separated by a slot 32 which extends the width of the body 20, FIG. 3. The slot 32 is defined by the linear upper edge 34 formed in the upper bridge 28, while the lower bridge 30 includes the linear slot edge 36 and the width and length of bridges 28 and 30 make the slot's edges rigid to keep line contact with the tube wall. The slot extends through the end regions 26 having a length equal to the length of the body 20.

Figure 4:
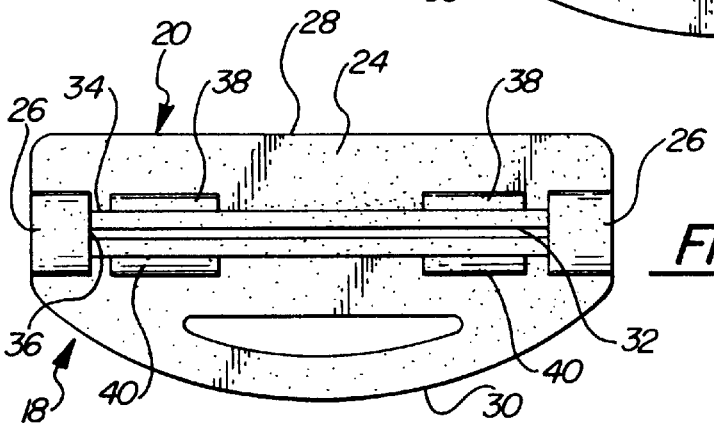
FIG. 4 is an elevational view of the clip body rear side.
Figure 5:
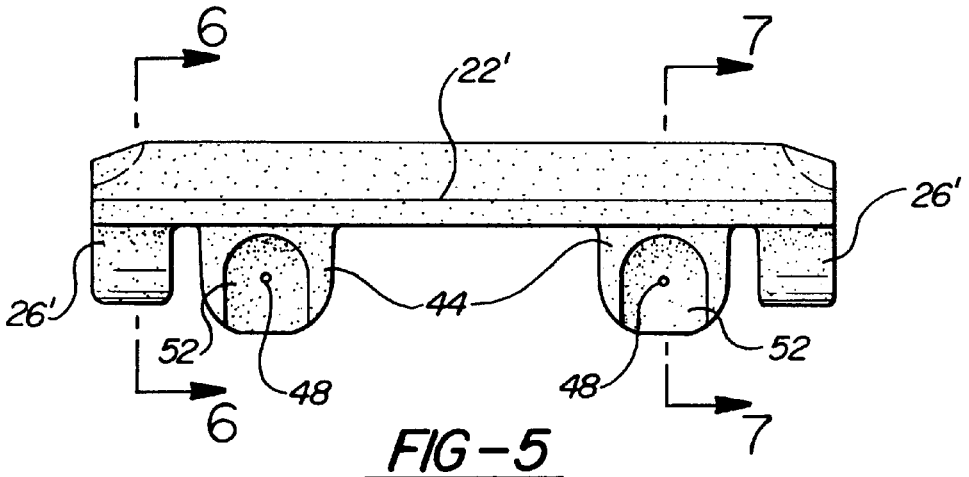
FIG. 5 is a top plan view of an embodiment of the invention utilizing retainers having holes therein whereby pins may be inserted through the retainers and tube for using the clip with highly viscous material.

Upon the rear side 24, two sets of retainer projections are defined. Each set consists of an upper projection 38 defined on the upper bridge 28 and a lower projection 40 defined upon the lower bridge 30. The projections 38 and 40 of a common set are in vertical alignment, as will be appreciated from FIG. 4.

In use, the tube closed end 16 is laterally inserted into the body 20 through one of the slotted end regions 26. Once the tube wall 12 is substantially "centered" between the end regions 26 as shown in FIG. 2, the body 20 can be moved longitudinally upon the tube wall 12 by grasping the tube end 16 and pushing the body 20 toward the cap 14. This action squeezes the paste material within the tube 10 toward the cap 14 due to the fact that the slot 32 is of a vertical dimension as to firmly engage the tube wall 12, but permit movement of the clip body 20 on the tube wall. The body 20 is moved toward the cap 14 as far as permitted by the material within the tube, such as shown in FIG. 1.

As the portion of the tube wall 12 extending to the left of the body 20 as shown in FIGS. 1 and 2, will have the tube material squeezed therefrom, this portion of the tube wall will be of a flat configuration, and can be readily folded at 42 so that the tube closed end 16 can be tucked under the upper retainer projections 38 as shown in FIGS. 1 and 2. As the material within the tube 10 is dispensed, the clip 18 may be progressively moved toward the cap 14 as desired, and each time the clip is moved on the tube, more of the tube adjacent the end 16 will be exposed to the left of the body 20. Accordingly, the portion of the tube 10 to the left of the body 20, FIGS. 1 and 2, can be refolded and retucked under the projections 38 so that even though the tube 10 may be substantially depleted of its contents, the dimensional extension of the empty and flattened tube wall 12 need not extend to the left of the body 20 a distance substantially greater than that shown in FIG. 2 in view of multiple foldings of the tube body prior to being tucked under the projection 38.

As the projections 40 are in alignment with their associated projections 38, the projections 40 tend to support the flattened portions of the tube wall as it is tucked under the projections 38 maintaining the integrity and relationship of the folded tube wall and end to the projections 38.

Once all of the contents of the tube 10 have been dispensed, the clip body 20 may be moved to the left after the folded portions of the tube wall 12 have been removed from under the retainer projections 38 and generally flattened. Thereupon, the tube wall 12 may be pulled from the clip 18.

An embodiment of the clip 18 is shown in FIGS. 5–9 wherein body components similar to those previously described are indicated by primed reference numerals.

Figure 6:
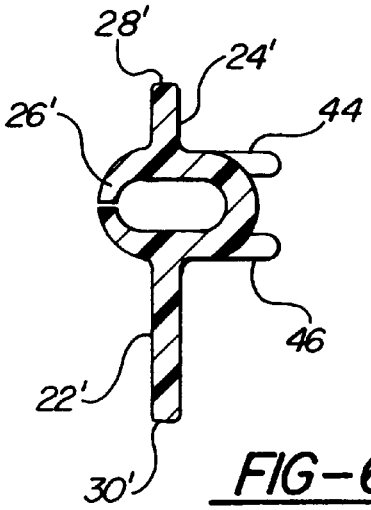
FIG. 6 is an elevational sectional view through the clip body as taken along Section 6—6 of FIG. 5.
Figure 7:
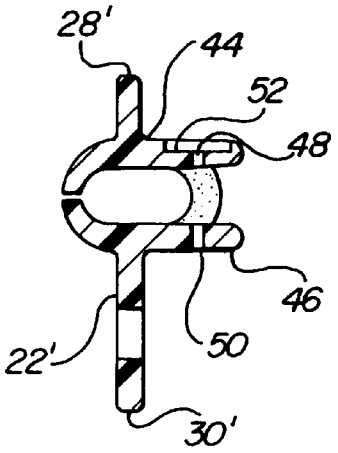
FIG. 7 is an elevational sectional view taken along Section 7—7 of FIG. 5.
Figure 8:
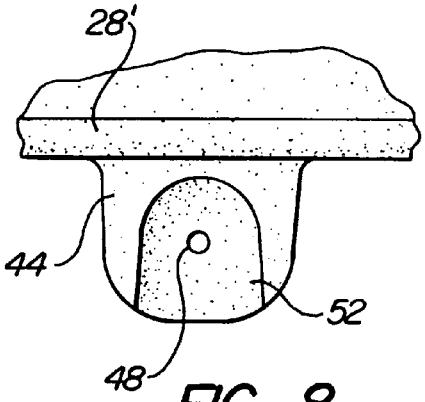
FIG. 8 is an enlarged detail plan view of a tube retaining extension having a pin hole defined therein.

In FIGS. 5–9, the clip body 20' includes retainer projections 44 and 46, a projection 44 and a projection 46 constituting an aligned set as will be appreciated from FIGS. 6 and 7. The upper projection 44 includes a hole 48 defined therein, while the lower projection 46 includes a hole 50 in alignment with the hole 48. The upper surface of the projection 44 is preferably countersunk at 52, FIGS. 5, 7 and 9.

Figure 9:
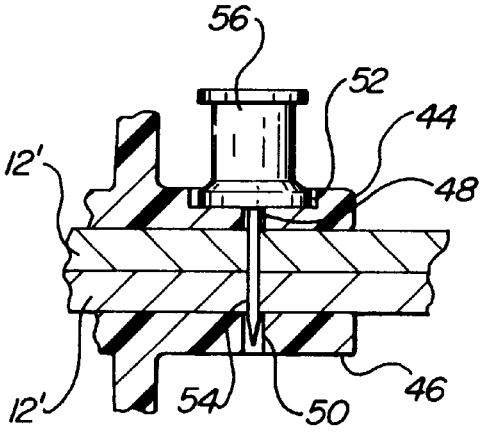
FIG. 9 is an elevational sectional view taken through the tube retaining projections illustrating a pin in place and extending through the tube walls.

The clip 18' is specifically used with very high viscous materials contained in plastic tubes having tube walls 12', FIG. 9. For instance, such a tube may contain a viscous construction adhesive. Because of the viscosity of the material contained in the tube, considerable compression of the tube walls 12' is required to expel the contents of the tube, and such pressure will impose a force on the clip body 20' which would tend to move the clip body on the tube wall toward the tube closed end, not shown. To prevent such inadvertent movement of the clip 18 on the tube, a headed pin 54 is inserted through each of the holes 48 of the projections 44, which is received within the holes 50 of the projections 46, as apparent in FIG. 9. Of course, this action causes the pins 54 to pierce the tube wall 12 ', FIG. 9, and prevents the dispensing pressure within the tube from displacing the clip 18 even though high internal pressures may be created within the tube.

With the embodiment of FIGS. 5–9, when it is desired to move the clip 18' further toward the tube cap, the pins 54 are removed by gripping the pin heads 56, the clip body 20' is positioned as desired, and the pins 54 reinserted through the holes 48 and 50.

It is appreciated that various modifications to the inventive concepts may be apparent to those skilled in the art without departing from the spirit and scope of the invention.

What is claimed is:

1. A tube clip for a flexible wall dispensing tube having a closed rear end, a flexible wall and a dispensing end, said clip including an elongated body having rear and front sides, an elongated slot defined in said body adapted to receive the closed end of a dispensing tube and squeeze the contents of the tube toward the tube dispensing end as said body is moved along the tube wall toward the dispensing end, and tube rear end retaining means mounted on said body rear side extending toward the tube closed end whereby the empty flattened portion of the tube adjacent the tube closed rear end may be folded to form a folded portion tucked under said retaining means and retained thereby, said tube rear end retaining means comprising a projection defined on said body rear side, said projection being spaced from said slot and of a length less than the length of said tube closed end folded portion.

2. In a tube clip as in claim 1, a handle defined on said body projecting from said body and of a length substantially equal to the length of said body.

3. In a tube clip as in claim 1, said clip body being molded of a synthetic material, said projection being homogeneously formed of the material of said body.

4. In a tube clip as in claim 3, a pair of spaced retaining means projections defined on said body.

5. A tube clip for a flexible wall dispensing tube having a closed rear end, a flexible wall and a dispensing end, said clip including an elongated body having rear and front sides, an elongated slot defined in said body adapted to receive the closed end of a dispensing tube and squeeze the contents of the tube toward the tube dispensing end as said body is moved along the tube wall toward the dispensing end, and tube rear end retaining means mounted on said body rear side extending toward the tube closed end whereby the empty flattened portion of the tube adjacent the tube closed rear end may be folded under said retaining means and retained thereby, said tube rear end retaining means comprising a set of projections defined on said body rear side, said set comprising a first projection and a second projection spaced from and opposed to said first projection, said projections of a set being on opposite sides of a plane constituting a projection of said slot, aligned holes defined in said projections of a common set having an axis substantially perpendicular to said projected plane of said slot, and a pin for extending through said holes whereby a tube within said body and slot will be penetrated by said pin to prevent movement of the tube within said slot.

6. In a tube clip as in claim 5, two sets of first and second projections defined on said body.

* * * * *